US011503971B2

(12) United States Patent
Kim et al.

(10) Patent No.: US 11,503,971 B2
(45) Date of Patent: Nov. 22, 2022

(54) CLEANING ROBOT

(71) Applicant: LG ELECTRONICS INC., Seoul (KR)

(72) Inventors: Hyongguk Kim, Seoul (KR); Jaeyoung Kim, Seoul (KR); Hyoungmi Kim, Seoul (KR); Yujune Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 469 days.

(21) Appl. No.: 16/487,684

(22) PCT Filed: May 30, 2019

(86) PCT No.: PCT/KR2019/006512
§ 371 (c)(1),
(2) Date: Aug. 21, 2019

(87) PCT Pub. No.: WO2020/241929
PCT Pub. Date: Dec. 3, 2020

(65) Prior Publication Data

US 2021/0321847 A1 Oct. 21, 2021

(51) Int. Cl.
*A47L 9/28* (2006.01)
*A47L 11/40* (2006.01)

(52) U.S. Cl.
CPC ..... *A47L 9/2826* (2013.01); *A47L 9/2815* (2013.01); *A47L 9/2847* (2013.01); *A47L 9/2894* (2013.01);
(Continued)

(58) Field of Classification Search
None
See application file for complete search history.

(56) References Cited

U.S. PATENT DOCUMENTS

2008/0229528 A1* 9/2008 Chen ..... A47L 9/2894 15/3
2014/0166047 A1 6/2014 Hillen et al.
(Continued)

FOREIGN PATENT DOCUMENTS

JP 2014-113488 6/2014
JP 2016-036725 3/2016
(Continued)

OTHER PUBLICATIONS

English Machine Translation of KR101670419B1.*
International Search Report dated Feb. 27, 2020 issued in Application No. PCT/KR2019/006512.

*Primary Examiner* — Mikhail Kornakov
*Assistant Examiner* — Pradhuman Parihar
(74) *Attorney, Agent, or Firm* — KED & Associates LLP

(57) ABSTRACT

A cleaning robot according to an embodiment of the present invention comprises: a traveling motor configured to generate a driving force for traveling; a cleaning module changing unit configured to selectively activate any one of at least one cleaning module; a sensing unit configured to sense characteristics of a floor surface; and a processor configured to perform a cleaning operation of cleaning the floor surface by controlling the cleaning module changing unit to activate any one of the at least one cleaning module based on the sensed characteristics of the floor surface, wherein the processor is configured to: sense characteristics of a contaminant present on the floor surface by using the sensing unit while performing the cleaning operation; and control the cleaning module changing unit to change or maintain the activated cleaning module based on the sensed characteristics of the contaminant.

18 Claims, 11 Drawing Sheets

(52) U.S. Cl.
CPC ..... *A47L 11/4011* (2013.01); *A47L 2201/04* (2013.01); *A47L 2201/06* (2013.01)

(56) References Cited

U.S. PATENT DOCUMENTS

| | | | | |
|---|---|---|---|---|
| 2016/0037983 | A1* | 2/2016 | Hillen ..... | A47L 9/2847 134/6 |
| 2019/0216285 | A1 | 7/2019 | Jang et al. | |

FOREIGN PATENT DOCUMENTS

| | | |
|---|---|---|
| KR | 10-1670419 | 10/2016 |
| KR | 10-2019-0000894 | 1/2019 |
| WO | WO 2019/056124 | 3/2019 |

* cited by examiner

CLEANING ROBOT

CROSS-REFERENCE TO RELATED PATENT APPLICATIONS

This application is a U.S. National Stage Application under 35 U.S.C. § 371 of PCT Application No. PCT/KR2019/006512, filed May 30, 2019, whose entire disclosures are hereby incorporated by reference.

TECHNICAL FIELD

The present invention relates to a cleaning robot, and more particularly, to a cleaning robot that autonomously travels a predetermined space to perform a cleaning operation.

BACKGROUND ART

Robots are machines that automatically process given tasks or operate with their own capabilities. The application fields of robots are generally classified into industrial robots, medical robots, aerospace robots, and underwater robots.

In recent years, the functions of robots have been expanded due to the development of autonomous navigation technology and automatic control technology using sensors. For example, cleaning robots are disposed in a large space such as an airport or a department store, and travel through the space to perform a cleaning operation.

Cleaning robots may autonomously perform the cleaning operation while traveling through the space by using map data and position information of the space.

Meanwhile, in the case of the large space in which the cleaning robots are disposed, the characteristics of the bottom surfaces may be different according to the position. In addition, since a large number of users exist in a large space, characteristics of contaminants generated on the bottom surfaces may also vary.

Therefore, there is a need to implement a cleaning robot that can provide effective cleaning performance even when placed in a space having various cleaning environments.

DISCLOSURE OF THE INVENTION

Technical Problem

An object of the present invention is to provide a cleaning robot capable of performing an optimal cleaning operation according to the characteristics of space and contaminants.

Another object of the present invention is to provide a cleaning robot capable of effectively sensing and removing contaminants which are difficult to visually sense.

Still another object of the present invention is to provide a cleaning robot for automatically performing an operation of managing a trash bin in a space.

Technical Solution

In one embodiment, a cleaning robot includes: a traveling motor configured to generate a driving force for traveling; a cleaning module changing unit configured to selectively activate any one of at least one cleaning module; a sensing unit configured to sense characteristics of a floor surface; and a processor configured to perform a cleaning operation of cleaning the floor surface by controlling the cleaning module changing unit to activate any one of the at least one cleaning module based on the sensed characteristics of the floor surface, wherein the processor is configured to: sense characteristics of a contaminant present on the floor surface by using the sensing unit while performing the cleaning operation; and control the cleaning module changing unit to change or maintain the activated cleaning module based on the sensed characteristics of the contaminant.

The sensing unit may include at least one of a camera or a floor sensor, and the processor may be configured to sense the characteristics of the floor surface based on at least one of an image acquired from the camera or a sensing value of the floor sensor.

The cleaning robot may further include a memory configured to store a learning model learned by a learning processor, wherein the processor may be configured to recognize the characteristics of the floor surface from at least one of the acquired image or the sensing value through the learning model stored in the memory.

The cleaning robot may further include a communication unit configured to connect to a server, wherein the processor may be configured to: control the communication unit to transmit at least one of the acquired image or the sensing value to the server; and receive, from the server, data including the characteristics of the floor surface based on at least one of the acquired image or the sensing value.

The sensing unit may include at least one of a camera, an odor sensor, or a liquid sensor, and the processor may be configured to sense the presence or absence of the contaminant or the characteristics of the contaminant based on at least one of an image acquired through the camera, a first sensing value acquired by the odor sensor, or a second sensing value acquired by the liquid sensor.

The processor may be configured to recognize the presence or absence of the contaminant or the characteristics of the contaminant from at least one of the image, the first sensing value, or the second sensing value through the learning model stored in the memory.

The cleaning module changing unit may include: a cleaning module switching motor; and a switching bar formed to extend along a rotational shaft of the cleaning module switching motor and fixed to each of the at least one cleaning module, wherein any one of the at least one cleaning module may be brought into contact with the floor surface based on a rotational angle of the switching bar and the cleaning module switching motor.

The processor may be configured to: select any one of the at least one cleaning module based on the sensed characteristics of the floor surface or the characteristics of the contaminant; and control the cleaning module switching motor such that the selected cleaning module is brought into contact with the floor surface.

The processor may be configured to change or maintain the activated cleaning module based on the sensed characteristics of the contaminant and perform the cleaning operation on the contaminant by controlling the traveling motor such that the cleaning module travels to a region where the contaminant is located.

The processor may be configured to: sense whether the contaminant remains by using the sensing unit after performing the cleaning operation on the contaminant; and when it is sensed that the contaminant remains, perform the cleaning operation on the remaining contaminant by controlling the traveling motor such that the cleaning module travels to a region where the contaminant remains.

The cleaning robot may further include a dust collecting motor and a dust container configured to accommodate foreign matter or dust suctioned according to the driving of the dust collecting motor, wherein the processor may be configured to drive or stop the dust collecting motor during traveling to the region where the contaminant is located, based on the sensed characteristics of the contaminant.

The cleaning robot may further include at least one ultraviolet light source configured to emit ultraviolet light to the floor surface.

When it is sensed that the sensed contaminant is a non-cleanable contaminant, the processor may be configured to control the traveling motor so as not to pass through the region where the contaminant is located.

The cleaning robot may further include a mark output unit configured to output a mark indicating the presence of the contaminant to the floor surface, wherein the processor may be configured to control the mark output unit to output the mark to a region where the non-cleanable contaminant is located or a adjacent region.

The processor may be configured to transmit information about the non-cleanable contaminant to at least one of a manager terminal, a server, or another cleaning robot through a communication unit.

The processor may be configured to: when a trash bin is sensed during traveling, control the traveling motor so as to approach the sensed trash bin; and sense a height of a trash accommodated in an inner module of the trash bin by using a distance measuring sensor, and control a pressing module to press the trash accommodated in the inner module based on the sensed height.

The cleaning robot may further include a trash bin management unit forming an accommodating space capable of accommodating the inner module and including the pressing module, wherein the processor may be configured to: move the inner module from the trash bin to the trash bin management unit based on the sensed height; and control the pressing module to press the trash accommodated in the inner module.

The processor may be configured to: calculate a pressing depth of the trash based on a position change of the pressing module; and move the inner module to the trash bin when the calculated pressing depth is greater than a reference depth.

The processor may be configured to: calculate a pressing depth of the trash based on a position change of the pressing module; and move another inner module accommodated in the trash bin management unit to the trash bin when the calculated pressing depth is less than a reference depth.

When the another inner module is not accommodated in the trash bin management unit, the processor may be configured to transmit a request for replacement of the inner module of the trash bin to at least one of a manager terminal, a server, or another cleaning robot through a communication unit.

Advantageous Effects

According to an embodiment of the present invention, since a cleaning robot senses characteristics of a floor surface or contaminants and provides a cleaning module and a cleaning method corresponding thereto, it is possible to effectively perform a cleaning operation on various kinds of floor surfaces or contaminants. Therefore, the cleaning performance of the cleaning robot may be maximized in a space having various environments such as a public place.

In addition, when the characteristics of the contaminants are not sensed, or when the non-cleanable contaminants are sensed, the cleaning robot may not perform the cleaning operation on the contaminants. Therefore, it is possible to prevent deterioration of cleanliness in the space and damage or error of the cleaning robot due to execution of the cleaning operation unsuitable for contaminants.

Furthermore, the cleaning robot may automatically manage the trash bins by pressing the trash accommodated in the trash bin disposed in the space or replacing the inner module of the trash bin, thereby maximizing the convenience of the manager.

BEST MODE

Figure 1:
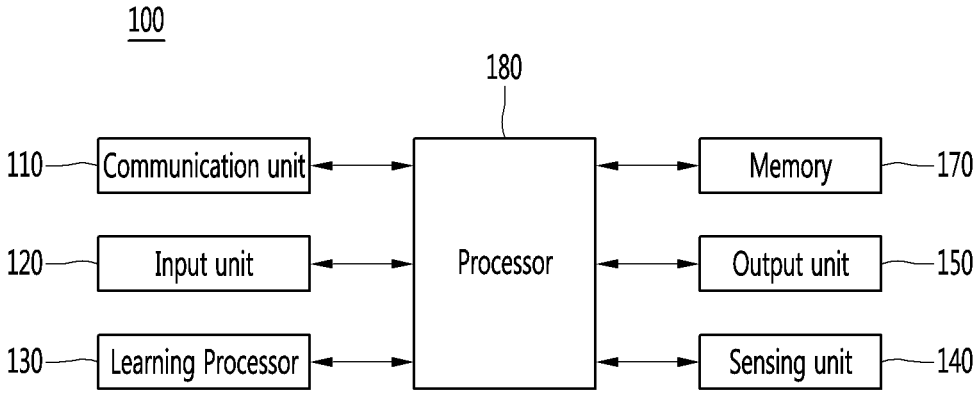
FIG. 1 illustrates an AI device including a robot according to an embodiment of the present invention.

Hereinafter, embodiments disclosed in this specification will be described in detail with reference to the accompanying drawings. The accompanying drawings are provided to facilitate the understanding of the embodiments disclosed herein, and are not intended to limit the technical idea disclosed in this specification by the attached drawings. It will be understood that the present invention is intended to cover all modifications, equivalents, and alternatives falling within the spirit and scope of the invention.

A robot may refer to a machine that automatically processes or operates a given task by its own ability. In particular, a robot having a function of recognizing an environment and performing a self-determination operation may be referred to as an intelligent robot.

Robots may be classified into industrial robots, medical robots, home robots, military robots, and the like according to the use purpose or field.

The robot may include a driving unit that includes an actuator or a motor and may perform various physical operations such as moving a robot joint. In addition, a movable robot may include a wheel, a brake, a propeller, and the like in a driving unit, and may travel on the ground through the driving unit or fly in the air.

Artificial intelligence refers to the field of studying artificial intelligence or methodology for making artificial intelligence, and machine learning refers to the field of defining various issues dealt with in the field of artificial intelligence and studying methodology for solving the various issues. Machine learning is defined as an algorithm that enhances the performance of a certain task through a steady experience with the certain task.

An artificial neural network (ANN) is a model used in machine learning and may mean a whole model of problem-solving ability which is composed of artificial neurons (nodes) that form a network by synaptic connections. The artificial neural network can be defined by a connection pattern between neurons in different layers, a learning process for updating model parameters, and an activation function for generating an output value.

The artificial neural network may include an input layer, an output layer, and optionally one or more hidden layers. Each layer includes one or more neurons, and the artificial neural network may include a synapse that links neurons to neurons. In the artificial neural network, each neuron may output the function value of the activation function for input signals, weights, and deflections input through the synapse.

Model parameters refer to parameters determined through learning and include a weight value of synaptic connection and deflection of neurons. A hyperparameter means a parameter to be set in the machine learning algorithm before learning, and includes a learning rate, a repetition number, a mini batch size, and an initialization function.

The purpose of the learning of the artificial neural network may be to determine the model parameters that minimize a loss function. The loss function may be used as an index to determine optimal model parameters in the learning process of the artificial neural network.

Machine learning may be classified into supervised learning, unsupervised learning, and reinforcement learning according to a learning method.

The supervised learning may refer to a method of learning an artificial neural network in a state in which a label for learning data is given, and the label may mean the correct answer (or result value) that the artificial neural network must infer when the learning data is input to the artificial neural network. The unsupervised learning may refer to a method of learning an artificial neural network in a state in which a label for learning data is not given. The reinforcement learning may refer to a learning method in which an agent defined in a certain environment learns to select a behavior or a behavior sequence that maximizes cumulative compensation in each state.

Machine learning, which is implemented as a deep neural network (DNN) including a plurality of hidden layers among artificial neural networks, is also referred to as deep learning, and the deep learning is part of machine learning. In the following, machine learning is used to mean deep learning.

Self-driving refers to a technique of driving for oneself, and a self-driving vehicle refers to a vehicle that travels without an operation of a user or with a minimum operation of a user.

For example, the self-driving may include a technology for maintaining a lane while driving, a technology for automatically adjusting a speed, such as adaptive cruise control, a technique for automatically traveling along a predetermined route, and a technology for automatically setting and traveling a route when a destination is set.

The vehicle may include a vehicle having only an internal combustion engine, a hybrid vehicle having an internal combustion engine and an electric motor together, and an electric vehicle having only an electric motor, and may include not only an automobile but also a train, a motorcycle, and the like.

At this time, the self-driving vehicle may be regarded as a robot having a self-driving function.

FIG. 1 illustrates an AI device 100 including a robot according to an embodiment of the present invention.

The AI device 100 may be implemented by a stationary device or a mobile device, such as a TV, a projector, a mobile phone, a smartphone, a desktop computer, a notebook, a digital broadcasting terminal, a personal digital assistant (PDA), a portable multimedia player (PMP), a navigation device, a tablet PC, a wearable device, a set-top box (STB), a DMB receiver, a radio, a washing machine, a refrigerator, a desktop computer, a digital signage, a robot, a vehicle, and the like.

Referring to FIG. 1, the AI device 100 may include a communication unit 110, an input unit 120, a learning processor 130, a sensing unit 140, an output unit 150, a memory 170, and a processor 180.

The communication unit 110 may transmit and receive data to and from external devices such as other AI devices 100*a* to 100*e* and the AI server 200 by using wire/wireless communication technology. For example, the communication unit 110 may transmit and receive sensor information, a user input, a learning model, and a control signal to and from external devices.

The communication technology used by the communication unit 110 includes GSM (Global System for Mobile communication), CDMA (Code Division Multi Access), LTE (Long Term Evolution), 5G, WLAN (Wireless LAN), Wi-Fi (Wireless-Fidelity), Bluetooth™, RFID (Radio Frequency Identification), Infrared Data Association (IrDA), ZigBee, NFC (Near Field Communication), and the like.

The input unit 120 may acquire various kinds of data.

At this time, the input unit 120 may include a camera for inputting a video signal, a microphone for receiving an audio signal, and a user input unit for receiving information from a user. The camera or the microphone may be treated as a sensor, and the signal acquired from the camera or the microphone may be referred to as sensing data or sensor information.

The input unit 120 may acquire a learning data for model learning and an input data to be used when an output is acquired by using learning model. The input unit 120 may acquire raw input data. In this case, the processor 180 or the learning processor 130 may extract an input feature by preprocessing the input data.

The learning processor 130 may learn a model composed of an artificial neural network by using learning data. The learned artificial neural network may be referred to as a learning model. The learning model may be used to an infer result value for new input data rather than learning data, and the inferred value may be used as a basis for determination to perform a certain operation.

At this time, the learning processor 130 may perform AI processing together with the learning processor 240 of the AI server 200.

At this time, the learning processor 130 may include a memory integrated or implemented in the AI device 100. Alternatively, the learning processor 130 may be implemented by using the memory 170, an external memory directly connected to the AI device 100, or a memory held in an external device.

The sensing unit 140 may acquire at least one of internal information about the AI device 100, ambient environment information about the AI device 100, and user information by using various sensors.

Examples of the sensors included in the sensing unit 140 may include a proximity sensor, an illuminance sensor, an acceleration sensor, a magnetic sensor, a gyro sensor, an inertial sensor, an RGB sensor, an IR sensor, a fingerprint recognition sensor, an ultrasonic sensor, an optical sensor, a microphone, a lidar, and a radar.

The output unit 150 may generate an output related to a visual sense, an auditory sense, or a haptic sense.

At this time, the output unit 150 may include a display unit for outputting time information, a speaker for outputting auditory information, and a haptic module for outputting haptic information.

The memory 170 may store data that supports various functions of the AI device 100. For example, the memory 170 may store input data acquired by the input unit 120, learning data, a learning model, a learning history, and the like.

The processor 180 may determine at least one executable operation of the AI device 100 based on information determined or generated by using a data analysis algorithm or a machine learning algorithm. The processor 180 may control the components of the AI device 100 to execute the determined operation.

To this end, the processor 180 may request, search, receive, or utilize data of the learning processor 130 or the memory 170. The processor 180 may control the components of the AI device 100 to execute the predicted operation or the operation determined to be desirable among the at least one executable operation.

When the connection of an external device is required to perform the determined operation, the processor 180 may generate a control signal for controlling the external device and may transmit the generated control signal to the external device.

The processor 180 may acquire intention information for the user input and may determine the user's requirements based on the acquired intention information.

The processor 180 may acquire the intention information corresponding to the user input by using at least one of a speech to text (STT) engine for converting speech input into a text string or a natural language processing (NLP) engine for acquiring intention information of a natural language.

At least one of the STT engine or the NLP engine may be configured as an artificial neural network, at least part of which is learned according to the machine learning algorithm. At least one of the STT engine or the NLP engine may be learned by the learning processor 130, may be learned by the learning processor 240 of the AI server 200, or may be learned by their distributed processing.

The processor 180 may collect history information including the operation contents of the AI apparatus 100 or the user's feedback on the operation and may store the collected history information in the memory 170 or the learning processor 130 or transmit the collected history information to the external device such as the AI server 200. The collected history information may be used to update the learning model.

The processor 180 may control at least part of the components of AI device 100 so as to drive an application program stored in memory 170. Furthermore, the processor 180 may operate two or more of the components included in the AI device 100 in combination so as to drive the application program.

Figure 2:
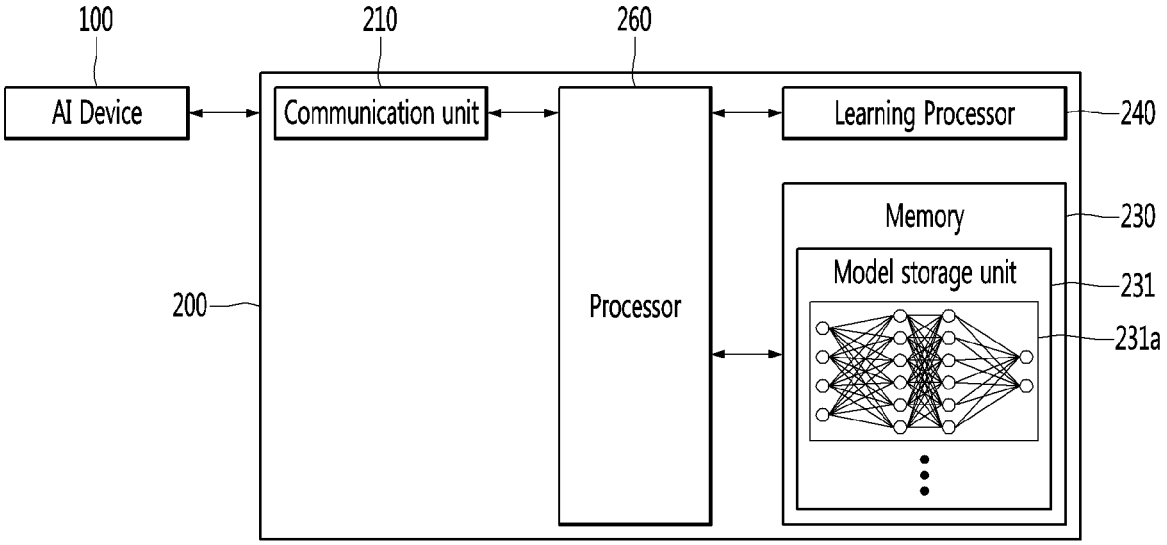
FIG. 2 illustrates an AI server connected to a robot according to an embodiment of the present invention.

FIG. 2 illustrates an AI server 200 connected to a robot according to an embodiment of the present invention.

Referring to FIG. 2, the AI server 200 may refer to a device that learns an artificial neural network by using a machine learning algorithm or uses a learned artificial neural network. The AI server 200 may include a plurality of servers to perform distributed processing, or may be defined as a 5G network. At this time, the AI server 200 may be included as a partial configuration of the AI device 100, and may perform at least part of the AI processing together.

The AI server 200 may include a communication unit 210, a memory 230, a learning processor 240, a processor 260, and the like.

The communication unit 210 can transmit and receive data to and from an external device such as the AI device 100.

The memory 230 may include a model storage unit 231. The model storage unit 231 may store a learning or learned model (or an artificial neural network 231*a*) through the learning processor 240.

The learning processor 240 may learn the artificial neural network 231*a* by using the learning data. The learning model may be used in a state of being mounted on the AI server 200 of the artificial neural network, or may be used in a state of being mounted on an external device such as the AI device 100.

The learning model may be implemented in hardware, software, or a combination of hardware and software. If all or part of the learning models are implemented in software, one or more instructions that constitute the learning model may be stored in memory 230.

The processor 260 may infer the result value for new input data by using the learning model and may generate a response or a control command based on the inferred result value.

Figure 3:
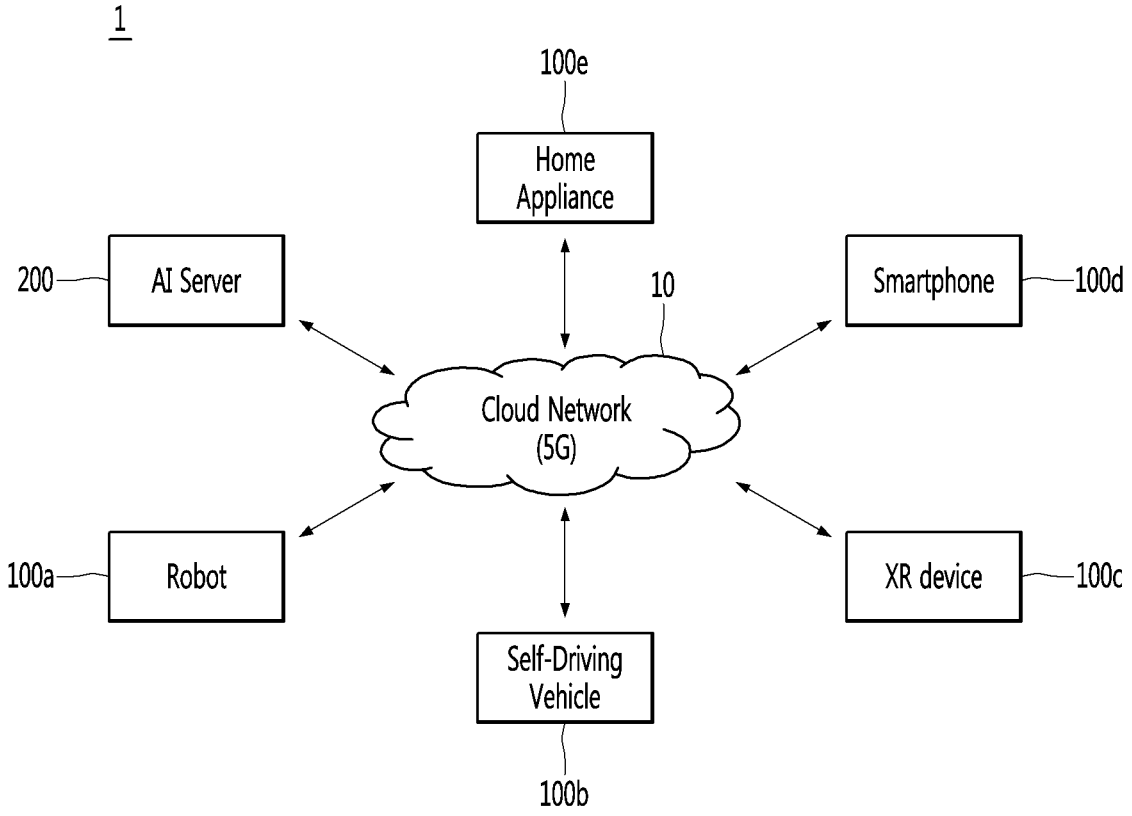
FIG. 3 illustrates an AI system according to an embodiment of the present invention.

FIG. 3 illustrates an AI system 1 according to an embodiment of the present invention.

Referring to FIG. 3, in the AI system 1, at least one of an AI server 200, a robot 100*a*, a self-driving vehicle 100*b*, an XR device 100*c*, a smartphone 100*d*, or a home appliance 100*e* is connected to a cloud network 10. The robot 100*a*, the self-driving vehicle 100*b*, the XR device 100*c*, the smartphone 100*d*, or the home appliance 100*e*, to which the AI technology is applied, may be referred to as AI devices 100*a* to 100*e*.

The cloud network 10 may refer to a network that forms part of a cloud computing infrastructure or exists in a cloud computing infrastructure. The cloud network 10 may be configured by using a 3G network, a 4G or LTE network, or a 5G network.

That is, the devices 100*a* to 100*e* and 200 configuring the AI system 1 may be connected to each other through the cloud network 10. In particular, each of the devices 100*a* to 100*e* and 200 may communicate with each other through a base station, but may directly communicate with each other without using a base station.

The AI server 200 may include a server that performs AI processing and a server that performs operations on big data.

The AI server 200 may be connected to at least one of the AI devices constituting the AI system 1, that is, the robot 100*a*, the self-driving vehicle 100*b*, the XR device 100*c*, the smartphone 100*d*, or the home appliance 100*e* through the cloud network 10, and may assist at least part of AI processing of the connected AI devices 100*a* to 100*e*.

At this time, the AI server 200 may learn the artificial neural network according to the machine learning algorithm instead of the AI devices 100*a* to 100*e*, and may directly store the learning model or transmit the learning model to the AI devices 100*a* to 100*e*.

At this time, the AI server 200 may receive input data from the AI devices 100*a* to 100*e*, may infer the result value for the received input data by using the learning model, may generate a response or a control command based on the inferred result value, and may transmit the response or the control command to the AI devices 100*a* to 100*e*.

Alternatively, the AI devices 100*a* to 100*e* may infer the result value for the input data by directly using the learning model, and may generate the response or the control command based on the inference result.

Hereinafter, various embodiments of the AI devices 100*a* to 100*e* to which the above-described technology is applied will be described. The AI devices 100*a* to 100*e* illustrated in FIG. 3 may be regarded as a specific embodiment of the AI device 100 illustrated in FIG. 1.

The robot 100*a*, to which the AI technology is applied, may be implemented as a guide robot, a carrying robot, a cleaning robot, a wearable robot, an entertainment robot, a pet robot, an unmanned flying robot, or the like.

The robot 100*a* may include a robot control module for controlling the operation, and the robot control module may refer to a software module or a chip implementing the software module by hardware.

The robot 100*a* may acquire state information about the robot 100*a* by using sensor information acquired from various kinds of sensors, may detect (recognize) surrounding environment and objects, may generate map data, may determine the route and the travel plan, may determine the response to user interaction, or may determine the operation.

The robot 100*a* may use the sensor information acquired from at least one sensor among the lidar, the radar, and the camera so as to determine the travel route and the travel plan.

The robot 100*a* may perform the above-described operations by using the learning model composed of at least one artificial neural network. For example, the robot 100*a* may recognize the surrounding environment and the objects by using the learning model, and may determine the operation by using the recognized surrounding information or object information. The learning model may be learned directly from the robot 100*a* or may be learned from an external device such as the AI server 200.

At this time, the robot 100*a* may perform the operation by generating the result by directly using the learning model, but the sensor information may be transmitted to the external device such as the AI server 200 and the generated result may be received to perform the operation.

The robot 100*a* may use at least one of the map data, the object information detected from the sensor information, or the object information acquired from the external apparatus to determine the travel route and the travel plan, and may control the driving unit such that the robot 100*a* travels along the determined travel route and travel plan.

The map data may include object identification information about various objects arranged in the space in which the robot 100*a* moves. For example, the map data may include object identification information about fixed objects such as walls and doors and movable objects such as pollen and desks. The object identification information may include a name, a type, a distance, and a position.

In addition, the robot 100*a* may perform the operation or travel by controlling the driving unit based on the control/interaction of the user. At this time, the robot 100*a* may acquire the intention information of the interaction due to the user's operation or speech utterance, and may determine the response based on the acquired intention information, and may perform the operation.

Figure 4:
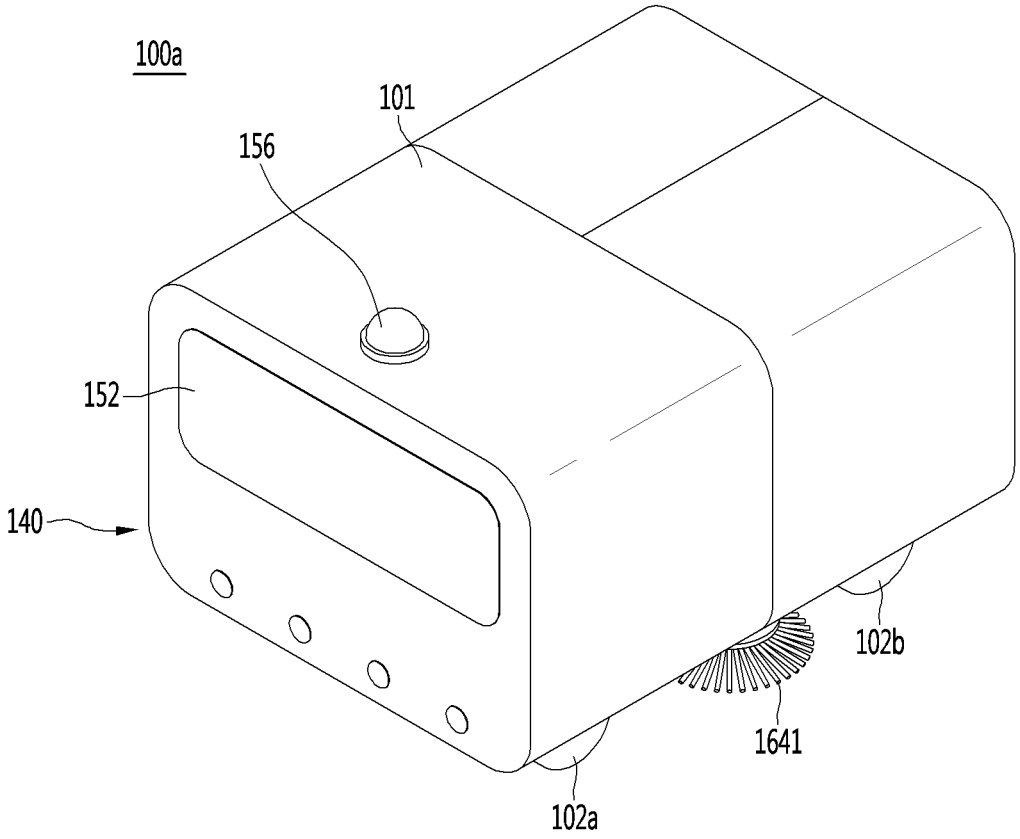
FIG. 4 is a perspective view of a cleaning robot according to an embodiment of the present invention.

FIG. 4 is a perspective view of a cleaning robot according to an embodiment of the present invention.

Referring to FIG. 4, the robot 100*a* may refer to a cleaning robot 100*a* that performs a cleaning operation while moving a predetermined area. For example, the cleaning robot 100*a* may perform the cleaning operation while moving in a wide area such as an airport or a department store, but the present invention is not necessarily limited thereto.

In order to perform the above-described operation, the cleaning robot 100*a* may include a cover 101 that surrounds various components and forms an appearance. FIG. 4 illustrates the cover 101 having a substantially rectangular parallelepiped shape, the shape of the cover 101 may be variously changed.

A sensing unit 140 including at least one sensor for sensing a surrounding environment of the cleaning robot 100*a* may be provided on at least one surface of the cleaning robot 100*a*.

For example, the sensing unit 140 may include a camera, a floor sensor, or the like for sensing information about the traveling of the cleaning robot 100*a* or sensing characteristics of the floor.

In addition, the sensing unit 140 may include a camera, an odor sensor, a liquid sensor, or the like for sensing characteristics of contaminants present on the floor.

According to the embodiment, the sensing unit 140 may further include a sensor (for example, a distance measuring sensor) for sensing an internal state of a trash bin disposed in a space.

For example, the camera, the floor sensor, the odor sensor, and the liquid sensor may be disposed at the front lower end of the cleaning robot 100*a*. Meanwhile, the distance measuring sensor may be disposed behind the cleaning robot 100*a*.

At least one wheel 102*a* and 102*b* for traveling may be provided at the lower side of the cleaning robot 100*a*. The at least one wheel 102*a* and 102*b* is rotated by a driving force provided from a traveling motor 166 (see FIG. 5), and allows the cleaning robot 100*a* to move forward or backward and rotate.

In addition, at least one cleaning module for removing contaminants (foreign matter, dust, etc.) present on the floor surface may be provided at the lower side of the cleaning robot 100*a*. According to the embodiment of the present invention, the cleaning robot 100*a* may perform the cleaning operation by using one of the at least one cleaning modules according to the characteristics of the floor surface (such as floor surface type) or the characteristics of the contaminants (kind of contaminants) sensed by the sensing unit 140 and the like.

According to the embodiment, the cleaning robot 100*a* may include a display 152 and/or a light output unit 156 for visually notifying the people around the cleaning robot 100*a* of the operating state or the presence or absence of contaminant. For example, the display 152 may be disposed on the front surface of the cleaning robot 100*a*, and the light output unit 156 may be disposed on the top surface of the cleaning robot 100*a*, but the present invention is not necessarily limited thereto.

Figure 5:
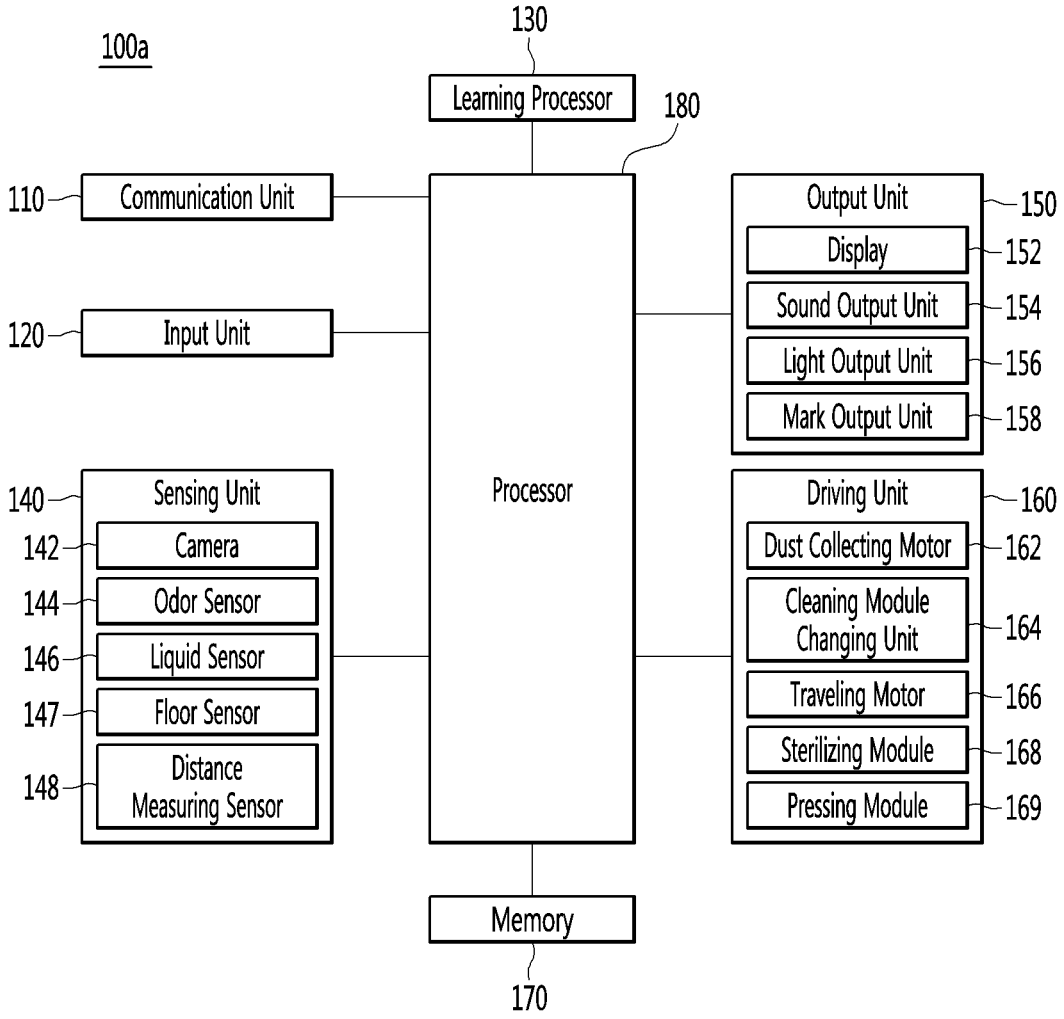
FIG. 5 is a block diagram illustrating a control configuration of a cleaning robot according to an embodiment of the present invention.

FIG. 5 is a block diagram illustrating the control configuration of the cleaning robot according to an embodiment of the present invention.

Referring to FIG. 5, the cleaning robot 100*a* may include a communication unit 110, an input unit 120, a learning processor 130, a sensing unit 140, an output unit 150, a driving unit 160, a memory 170, and a processor 180. The configurations illustrated in FIG. 5 are examples for convenience of explanation, and the cleaning robot 100*a* may include more or fewer configurations than those illustrated in FIG. 5.

Meanwhile, the contents related to the AI device 100 of FIG. 1 is also similarly applied to the robot 100*a* of the present invention, and redundant contents thereof will be omitted.

The communication unit 110 may include communication modules for connecting the cleaning robot 100*a* to a server, a mobile terminal, another robot, or the like via a network. Each of the communication modules may support any of the communication technologies described above in FIG. 1.

For example, the cleaning robot 100*a* may be connected to the network via an access point such as a router. Therefore, the cleaning robot 100*a* may provide a variety of information acquired through the input unit 120, the sensing unit 140, and the like to the server or the mobile terminal via the network.

The input unit 120 may include at least one input means for acquiring various kinds of data. For example, the at least one input means may include a physical input means such as a button or a dial, a touch input means such as a touch pad or a touch panel, a microphone for receiving a voice of the user or a sound around the cleaning robot 100*a*. The user may input various requests or commands through the input unit 120 to the cleaning robot 100*a*.

The sensing unit 140 may include at least one sensor for sensing a variety of information around the cleaning robot 100*a*. For example, the sensing unit 140 may include a camera 142 and various sensors such as an odor sensor 144, a liquid sensor 146, a floor sensor 147, and a distance measuring sensor 148.

The camera 142 may acquire images around the cleaning robot 100*a*. According to the embodiment, the camera 142 may include a plurality of image sensors, and the processor 180 may sense the distance to the surrounding objects based on the images acquired from each of the plurality of image sensors.

The odor sensor 144 may be implemented by various chemical sensors, gas sensors, or the like for acquiring a sensing value indicating characteristics of gas generated from materials (contaminants, etc.) around the cleaning robot 100*a*.

The liquid sensor 146 may sense whether the contaminant present on the floor surface around the cleaning robot 100*a* is a liquid contaminant. For example, the liquid sensor 146 may be implemented by a humidity sensor, but the present invention is not limited thereto.

Since the cleaning robot 100*a* includes the odor sensor 144 and the liquid sensor 146, the cleaning robot 100*a* may effectively sense contaminants and chemicals that are not easily visually detected.

The floor sensor 147 may sense a height difference on the floor surface such as a stair during the traveling of the cleaning robot 100*a*, or may acquire a sensing value for sensing the characteristics (type, material, etc.) of the floor surface. For example, the floor sensor 147 may include at least one infrared sensor disposed on the bottom surface of the cleaning robot 100*a*, but the present invention is not limited thereto.

The distance measuring sensor 148 may sense the internal state of the trash bin disposed in the space, as will be described later in the embodiment of FIGS. 12 to 14. For example, the distance measuring sensor 148 may include a laser light source that emits a laser beam and a light receiving unit that receives a laser beam reflected from the object. The distance measuring sensor 148 may sense the height of the trash accommodated in the trash bin based on the received time.

The processor 180 may acquire the forward image through the camera 142 and may control the traveling direction or the traveling speed of the cleaning robot 100*a* based on the obtained forward image. For example, the processor 180 may recognize various objects or obstacles included in the image through various known image recognition techniques. The processor 180 may recognize the position of the cleaning robot 100*a* based on the recognized objects or the like. Further, the processor 180 may set or change the traveling route based on the recognized objects or obstacles, and may control the traveling motor 166 based on the set or changed traveling route.

Meanwhile, the processor 180 may distinguish the characteristics of the floor surface (e.g., wood floor, cement floor, carpet, etc.) based on the image acquired through the camera 142 and the sensing value of the floor sensor 147. The memory 170 may store an algorithm or data for distinguishing the characteristics of the floor surface based on the image and/or the sensing value.

Meanwhile, the processor 180 may determine the presence or absence of contaminant on the floor and the characteristics of the contaminant based on the image acquired through the camera 142 or the sensing value of the odor sensor 144 and/or the liquid sensor 146. The memory 170 may store an algorithm or data for detecting the presence or absence of contaminant and the characteristics of contaminant based on the image and/or the sensing value.

According to the embodiment, the processor 180 may transmit the image and/or sensing value acquired through the sensing unit 140 to the server through the communication unit 110. The server may analyze the image and/or the sensing value to acquire information about the characteristics of the floor surface, the presence or absence of contaminant, and/or the characteristics of the contaminant, and provide the acquired information to the cleaning robot 100*a*. According to the embodiment, the server may be implemented by the AI server 200 described with reference to FIG. 2. In this case, the server may recognize the characteristics of the floor surface, the presence or absence of the contaminant, and/or the characteristics of the contaminant from the image and/or the sensing value through the model (artificial neural network 231*a*) learned through the learning processor 240. The processor 180 may control the cleaning operation based on the recognition result.

According to the embodiment, the processor 180 may directly recognize the characteristics of the floor surface, the presence or absence of the contaminant, and/or the characteristics of the contaminant from the image and/or the sensing values through the model learned by the learning processor 130 in the cleaning robot 100*a*. Alternatively, the processor 180 may receive data corresponding to the learned model from the server, store the received data in the memory 170, and recognize the characteristics of the floor surface, the presence or absence of the contaminant, and/or the characteristics of the contaminant from the image and/or the sensing values through the stored data.

The output unit 150 may output a variety of information about the operation or state of the cleaning robot 100*a* and various services, programs, and applications executed by the cleaning robot 100*a*.

The output unit 150 may include a display 152, a sound output unit 154, and a light output unit 156, and the like.

The display 152 may output the variety of above-described information or messages in a graphic form. According to the embodiment, the display 152 may be implemented in the form of a touch screen with a touch input unit. In this case, the display 152 may function as an input means as well as an output means.

The sound output unit 154 may output the variety of information and messages in voice or sound form. For example, the sound output unit 154 may include a speaker.

The light output unit 156 may include a light source such as an LED. For example, the light output unit 156 may be implemented as a flashing light as illustrated in FIG. 4, but the present invention is not limited thereto. The processor 180 may indicate the state of the cleaning robot 100*a* or the like through the light output unit 156. According to the embodiment, the light output unit 156 may output a variety of information together with the display 152 and/or the sound output unit 154 as an auxiliary output means.

According to the embodiment, the output unit 150 may further include a mark output unit 158 for notifying a user of the presence of the contaminant by outputting (printing or projecting) a mark to a region where the contaminant is located or a region adjacent thereto. The mark output unit 158 may include a print module that prints the mark on the floor surface, or a beam projector that projects the mark on the floor surface.

When non-removable contaminant is sensed, the processor 180 may control the mark output unit 158 to output the mark to the region where the contaminant is located or the adjacent region, so as to notify the user of the presence of the contaminant. The related contents will be described later in detail with reference to FIG. 11.

The driving unit 160 may include cleaning operations of the cleaning robot 100*a* and the configurations related to traveling. The driving unit 160 may include a dust collecting motor 162, a cleaning module changing unit 164, a traveling motor 166, a sterilizing module 168, and a pressing module 169, but the present invention is not limited thereto. The driving unit 160 may include fewer or more components.

The dust collecting motor 162 may be driven to suction foreign matter or dust on the floor surface. When the dust collecting motor 162 is driven, foreign matter or dust on the floor surface may be suctioned and accommodated into the dust container in the cleaning robot 100*a* through the suction port formed at the lower portion of the cleaning robot 100*a*.

The cleaning module changing unit 164 may cause one of at least one cleaning modules to contact the floor surface based on the characteristics of the floor surface and/or the characteristics of the contaminant sensed by the sensing unit 140 or the like. For example, the at least one cleaning module may include a brush, an oil mop, a wet mop, and a carpet brush, but the present invention is not limited thereto. The embodiment related to the cleaning module changing unit 164 will be described later with reference to FIG. 7.

The traveling motor 166 is connected to at least one wheel 102*a* and 102*b* to provide the driving force for traveling the cleaning robot 100*a* to the wheels 102*a* and 102*b*. For example, the cleaning robot 100*a* may include at least one traveling motor 166, and the processor 180 may control the at least one traveling motor 166 to adjust the traveling direction and/or the traveling speed.

The sterilizing module 168 may be disposed on the bottom surface of the cleaning robot 100*a* to sterilize microorganisms, bacteria, and the like present on the floor surface. For example, the sterilizing module 168 may include at least one UV lamp or at least one UV LED that emits ultraviolet light.

The pressing module 169 may reduce the height of the trash accommodated in the inner module by pressing the accommodated trash downward when the trash is accommodated to a predetermined height or more in the inner module of the trash bin disposed in the space. Embodiments related to the pressing module 169 will be described later with reference to FIGS. 12 to 14.

The memory 170 may store various data such as control data for controlling the operations of the components included in the cleaning robot 100*a* and data for performing the operation based on the pressure acquired through the input unit 120 or the information acquired through the sensing unit 140.

In addition, the memory 170 may store program data such as software modules or applications executed by at least one processor or controller included in the processor 180.

In addition, the memory 170 according to the embodiment of the present invention may store an image recognition algorithm for recognizing an object from an image acquired through the camera 142. In addition, the memory 170 may store an algorithm or data for sensing the characteristics of the floor surface and/or the characteristics of the contaminant based on the image and/or the sensing value acquired through the sensing unit 140. In addition, the memory 170 may store information about the cleaning modules corresponding to the sensed characteristics of the floor surface and/or the sensed characteristics of the contaminant, information about whether the contaminant is cleanable, or various algorithms or data related to the embodiments of the present invention.

The memory 170 may include various storage devices such as ROM, RAM, EEPROM, flash drive, or hard drive in hardware.

The processor 180 may include at least one processor or controller for controlling the operation of the robot 100*a*. Specifically, the processor 180 may include at least one of a CPU, an application processor (AP), a microcomputer (or microcomputer), an integrated circuit, or an application specific integrated circuit (ASIC).

The processor 180 may control the overall operations of the configurations included in the robot 100*a*. In addition, the processor 180 may include an ISP that processes image signals obtained through the camera 142 to generate image data, a display controller that controls the operation of the display 152, and the like.

Figure 6:
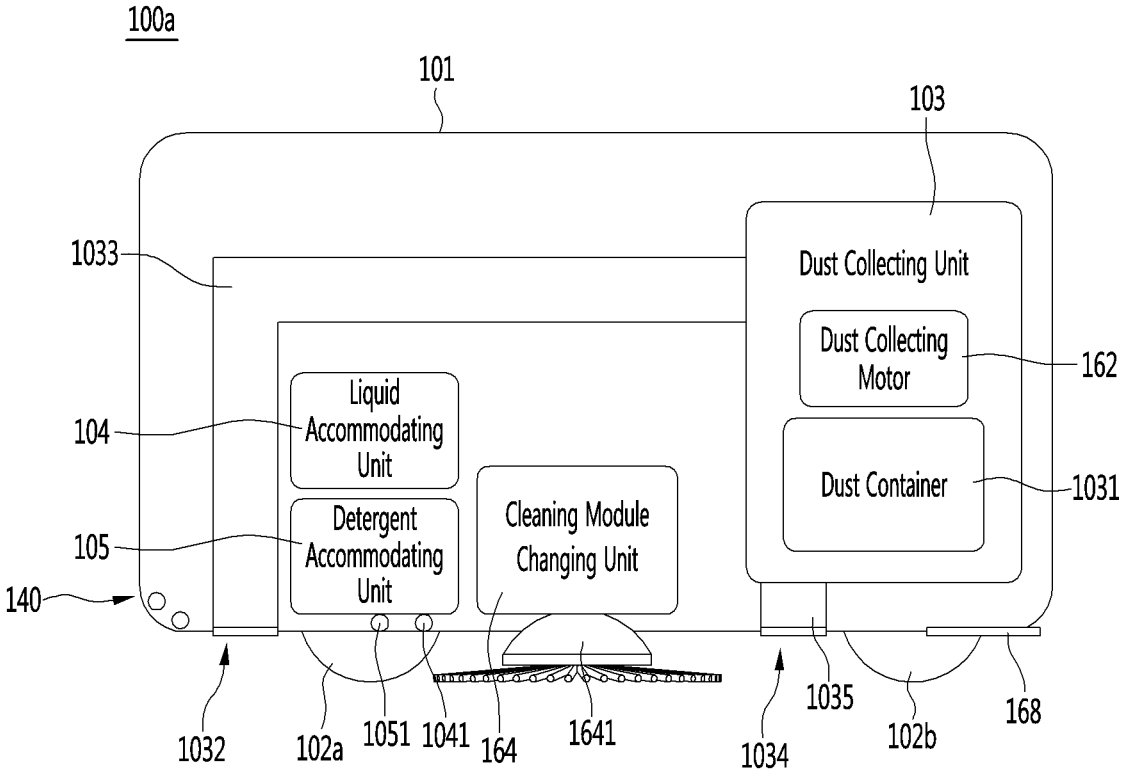
FIG. 6 illustrates an example of the arrangement of configurations related to a cleaning operation of a cleaning robot according to an embodiment of the present invention.
Figure 7:
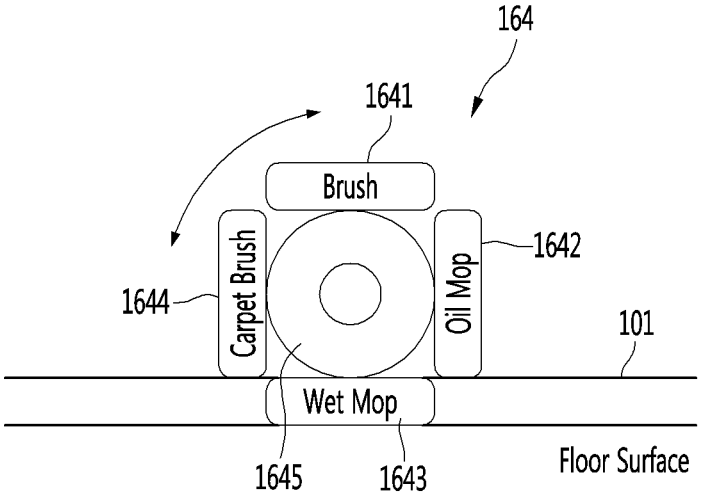
FIG. 7 is a diagram illustrating an example related to a configuration of a cleaning module changing unit of FIG. 6.

FIG. 6 illustrates an example of the arrangement of the configurations related to the cleaning operation of the cleaning robot according to an embodiment of the present invention. FIG. 7 is a diagram illustrating an example related to the configuration of the cleaning module changing unit of FIG. 6.

FIG. 6 is a side view of the cleaning robot 100*a*. The position where the sensing unit 140 is disposed corresponds to the front of the cleaning robot 100*a*, and the position where the sterilizing module 168 is disposed corresponds to the rear of the cleaning robot 100*a*. The cleaning robot 100*a* may perform a cleaning operation while traveling forward in a general situation.

Referring to FIG. 6, a dust collecting unit 103, a liquid accommodating unit 104, a detergent accommodating unit 105, and a cleaning module changing unit 164 may be accommodated in the inner space formed by the cover 101 of the cleaning robot 100*a*.

The dust collecting unit 103 corresponds to a structure for removing foreign matter or dust present on the floor surface. The dust collecting unit 103 may include a dust container 1031 that forms an accommodating space in which foreign matter or dust suctioned through the suction ports 1032 and 1034 are accommodated, suction ports 1032 and 1034 formed on the bottom surface of the cleaning robot 100*a*, suction passages 1033 and 1035 formed between the suction ports 1032 and 1034 and the dust container 1031, and a dust collecting motor 162 that generates a suction force.

The first suction port 1032 may be formed in front of the cleaning module changing unit 164, and the second suction port 1034 may be formed behind the cleaning module changing unit 164. That is, foreign matter or dust of a solid form existing on the floor surface may be suctioned by the first suction port 1032, or may be separated from the floor surface by the cleaning module (for example, the brush) and then suctioned by the second suction port 1034. For example, the size of the foreign matter suctioned through the first suction port 1032 may be larger than the size of the foreign matter suctioned through the second suction port 1034, but the present invention is not necessarily limited thereto.

The processor 180 may continuously drive the dust collecting motor 162 while the cleaning robot 100*a* is traveling. Alternatively, the processor 180 may drive the dust collecting motor 162 to suction the contaminant into the dust container 1031 when the solid contaminant is detected during traveling. Meanwhile, the dust collecting motor 162 may not be driven when the processor 180 senses liquid type contaminants (drinking water, etc.) during traveling, or when contaminants (excretion, stains, etc.) that should be removed by using liquid (water or oil) and/or detergent.

The liquid accommodating unit 104 may form an accommodating space for accommodating a liquid (water and/or oil). When the sensed contaminant corresponds to a contaminant that can be removed or decomposed by water or oil, the processor 180 may supply (spray) the water or the oil to the floor surface through a liquid spraying port 1041 connected to the liquid accommodating unit 104. To this end, a spraying device for spraying the liquid accommodated in the liquid accommodating unit 104 may be provided in the liquid accommodating unit 104, the liquid spraying port 1041, or between the liquid accommodating unit 104 and the liquid spraying port 1041.

The detergent accommodating unit 105 may form an accommodating space for accommodating the detergent. When the sensed contaminant is a contaminant that can be removed by the detergent, the processor 180 may supply (spray) the detergent to the floor surface through a detergent spraying port 1051 connected to the detergent accommodating unit 105. To this end, a spraying device for spraying the detergent accommodated in the detergent accommodating unit 105 may be provided in the detergent accommodating unit 105, the detergent spraying port 1051, or between the detergent accommodating unit 105 and the detergent spraying port 1051.

The cleaning module changing unit 164 may cause any one of the at least one cleaning module to face the floor surface according to the control of the processor 180 to bring the cleaning modules into contact with the floor surface. In this case, among the at least one cleaning module, the cleaning module brought into contact with the floor surface may be defined as a cleaning module that is currently activated.

In this regard, referring to FIG. 7, the cleaning module changing unit 164 may include at least one cleaning module 1641 to 1644, and a cleaning module switching device 1645 that selectively activates one of the at least one cleaning module 1641 to 1644.

As an example of the at least one cleaning module 1641 to 1644, a brush 1641, an oil mop 1642, a wet mop 1643, and a carpet brush 1644. However, the type of the cleaning module is diverse.

For example, the cleaning module switching device 1645 may include a cleaning module switching motor (not illustrated) rotated by the control of the processor 180, and a switching bar which is connected to the cleaning module switching motor and to which the at least one cleaning module 1641-1644 is fixed.

The cleaning module switching motor may be disposed such that the rotational shaft corresponds to the left and right direction of the cleaning robot 100*a*. The switching bar may be formed to extend along the rotational shaft of the cleaning module switching motor. The length of the switching bar may correspond to the length of the cleaning robot 100*a* in the lateral direction, but the present invention is not necessarily limited thereto.

The at least one cleaning module 1641 to 1644 may be fixed to the switching bar. Each of the at least one cleaning modules 1641-1644 may have a length corresponding to that of the switching bar, but the present invention is not necessarily limited thereto.

For example, as illustrated in FIG. 7, the at least one cleaning module 1641 to 1644 may be fixed to the switching bar such that only one cleaning module faces the floor surface when the switching bar is rotated. That is, depending on the rotational angle of the cleaning module switching motor and the switching bar, one of the cleaning modules faces the floor surface in correspondence with the rotational angle and contacts the floor surface, such that the cleaning module can be activated.

Referring back to FIG. 6, the sterilizing module 168 is disposed on the bottom surface of the cleaning robot 100*a* and may emit ultraviolet light for sterilization to the floor surface. For example, the sterilizing module 168 may be disposed behind the cleaning module changing unit 164 on the bottom surface of the cleaning robot 100*a* so as to finally perform the sterilizing operation on the region where the cleaning operation is performed. However, the arrangement position of the sterilizing module 168 may be freely changed.

Figure 8:
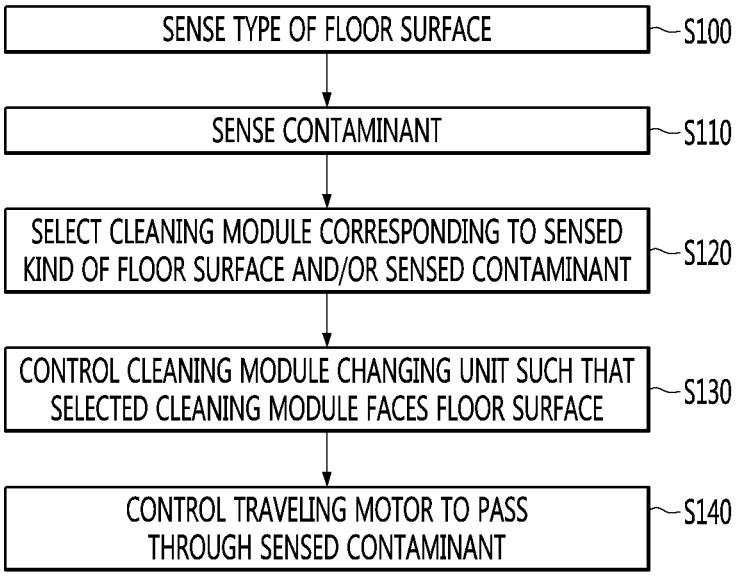
FIG. 8 is a flowchart for describing the control operation of the cleaning robot according to an embodiment of the present invention.

FIG. 8 is a flowchart for describing the control operation of the cleaning robot according to an embodiment of the present invention.

Referring to FIG. 8, the cleaning robot 100*a* may sense the characteristics (for example, kind) of the floor surface through the sensing unit 140 during traveling (S100), and may sense the contaminant present on the floor surface (S110).

The processor 180 may sense the characteristics (kind, material, etc.) of the floor surface on which the cleaning robot 100*a* is traveling or is scheduled to travel, based on the image acquired through the camera 142 and/or the sensing value of the floor sensor 147. For example, the processor 180 may sense the characteristics of the floor surface based on the color, pattern, or the like of the floor surface included in the image, or may sense the characteristics of the floor surface based on a sensing value change pattern of the floor sensor 147.

In addition, the processor 180 may sense the presence or absence of the contaminant in front of the cleaning robot 100*a* and the characteristics of the contaminant, based on the image acquired through the camera 142 and/or the sensing value acquired by at least one of the odor sensor 144 or the liquid sensor 146. For example, the processor 180 may sense the presence or absence of the contaminant and the characteristics of the contaminant based on the color, pattern, contour of the contaminant, etc. included in the image, or may sense the presence or absence of the contaminant and the characteristics of the contaminant from the sensing values of the sensors 144 and 146.

According to the embodiment, the processor 180 may transmit data including the image and/or the sensing value to the server. The server may be the AI server 200 described above with reference to FIG. 2. In this case, the server may sense the characteristics of the floor surface or the characteristics of the contaminant from the image and/or the sensing value through the model (artificial neural network 231*a*) learned through the learning processor 240, and may transmit the sensing result to the cleaning robot 100*a*.

According to the embodiment, the processor 180 may sense the characteristics of the floor surface or the characteristics of the contaminant from the image and/or the sensing value through the model learned by the learning processor 130 in the cleaning robot 100*a* or the model (artificial neural network) received from the server.

The cleaning robot 100*a* may select the cleaning module corresponding to the sensed characteristics of the floor surface and/or the sensed characteristics of the contaminant (S120). The cleaning robot 100*a* may control the cleaning module changing unit 164 such that the selected cleaning module faces the floor surface (S130).

For example, the memory 170 may store information about the cleaning module corresponding to the characteristics of the floor surface and information about the cleaning module corresponding to the characteristics of the contaminant.

The processor 180 may select the cleaning module to be activated by acquiring, from the memory 170, the information about the cleaning module corresponding to the sensed characteristics of the floor surface and/or the sensed characteristics of the contaminant.

The processor 180 may control the motor 1645 of the cleaning module changing unit 164 such that the selected cleaning module faces the floor surface. The selected cleaning module may be activated by changing its position to contact the bottom surface according to the control of the motor 1645.

For example, the processor 180 may sense the characteristics of the floor surface by using the sensing unit 140, and activate the cleaning module according to the sensed characteristics of the floor surface to perform the cleaning operation on the floor surface.

During the cleaning operation on the floor surface, the processor 180 may sense the characteristics of the contaminant present on the floor surface by using the sensing unit 140, and may change or maintain the activated cleaning module according to the sensed characteristics of the contaminant to perform the cleaning operation with respect to the contaminant.

According to the embodiment, when there is no cleaning module corresponding to the sensed contaminant, or when the sensed contaminant is set as non-cleanable contaminant, the processor 180 may recognize that the cleaning of the contaminant is impossible. According to the recognition result, the processor 180 may control the mark output unit 158 to output (print or project) the mark indicating that the contaminant is present in the region where the contaminant exists or in the adjacent region. The related embodiment will be described later with reference to FIG. 11.

In addition, the processor 180 may transmit information (type, position, etc.) of the contaminant to the manager terminal, the server, or another cleaning robot through the communication unit 110 to allow the manager or another cleaning robot to guide the processing of the contaminant.

The cleaning robot 100*a* may control the traveling motor 166 so as to pass through the region where the sensed contaminant is present (S140).

In order to remove the sensed contaminant, the processor 180 may control the traveling motor 166 so as to pass through the region where the contaminant is present. The cleaning robot 100*a* may remove the contaminant by using the activated cleaning module while passing through the region where the contaminant is present.

In addition, based on the characteristics of the sensed contaminant, the processor 180 may control the operation of the dust collecting motor 162 and/or the sterilizing module 168, or may control the spraying of the liquid accommodated in the liquid accommodating unit 104 and/or the detergent accommodated in the detergent accommodating unit 105.

Figure 9:
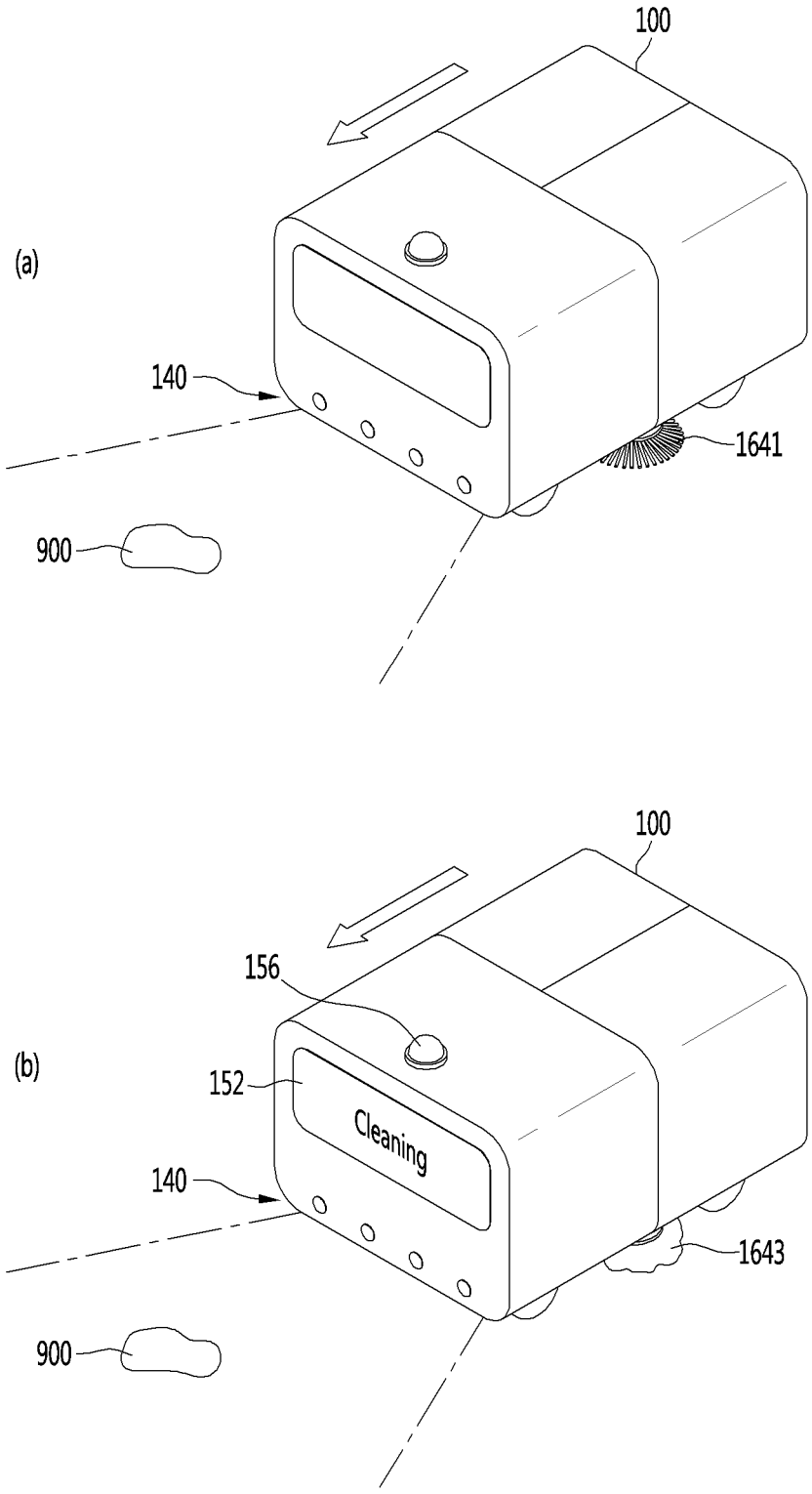
FIGS. 9 and 10 are diagrams illustrating an example related to the control operation of the cleaning robot of FIG. 8.
Figure 10:
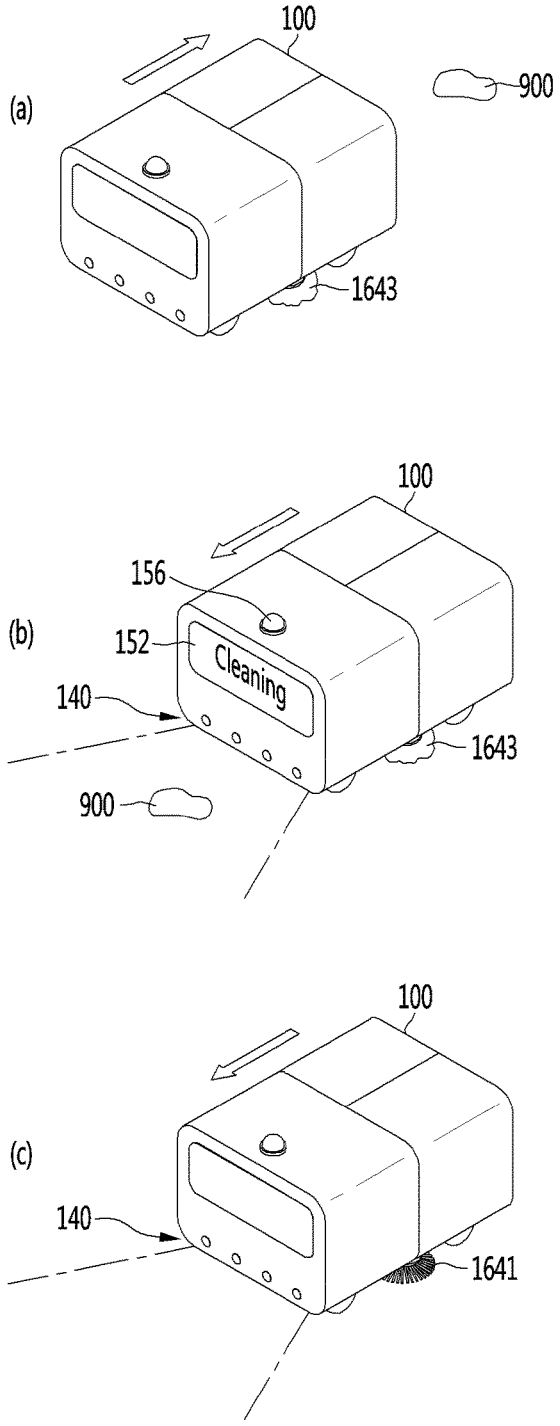

FIGS. 9 and 10 are diagrams illustrating an example related to the control operation of the cleaning robot of FIG. 8.

Referring to FIG. 9(*a*), the cleaning robot 100*a* may sense the contaminant 900 present in the front by using the sensing unit 140 during traveling and may activate any one of the at least one cleaning module 1641 to 1644 based on the sensed characteristics of the contaminant 900.

For example, when the sensed contaminant 900 is a liquid contaminant, the processor 180 may control the cleaning module changing unit 164 to activate the wet mop 1643 instead of the currently active brush 1641, as illustrated in FIG. 9(*b*).

After the wet mop 1643 is activated, the processor 180 may control the traveling motor 166 so as to pass through the region where the contaminant 900 is present.

Meanwhile, the processor 180 may stop the driving of the dust collecting motor 162 to prevent the liquid contaminant from flowing into the dust container. According to the embodiment, the processor 180 may spray the liquid (water or oil) or the detergent to the region where the contaminant 900 is present during passage of the contaminant 900, thereby more effectively removing the contaminant 900 than the wet mop 1643.

According to the embodiment, the processor 180 may notify surrounding people that the cleaning operation is being performed through the output unit 150. For example, the processor 180 may display a text indicating that the cleaning operation is being performed through the display 152, or may output light indicating that the cleaning operation is being performed through the light output unit 156. According to the embodiment, the processor 180 may output a voice or sound indicating that the cleaning operation is being performed through the sound output unit 154.

Meanwhile, referring to FIG. 10A, the cleaning robot 100*a* may check whether the contaminant 900 has been removed after passing through the region where the contaminant 900 is located.

For example, the processor 180 may control the traveling motor 166 to move the cleaning robot 100*a* backward, or may perform control such that the region where the presence of the contaminant 900 has been sensed through various other types of travel control is disposed in front of the cleaning robot 100*a*.

After the traveling control, the processor 180 may confirm whether the contaminant remains in the region where the presence of the contaminant 900 has been detected by using the sensing unit 140.

When it is confirmed that the contaminant 900 partially remains as illustrated in FIG. 10(*b*), the processor 180 may perform the cleaning operation again on the remaining contaminant 900 as illustrated in FIG. 9.

Meanwhile, when it is confirmed that the contaminant is completely removed as illustrated in FIG. 10(*c*), the processor 180 may recognize that the cleaning of the contaminant 900 is completed and may continue the traveling. At this time, the processor 180 may sense the characteristics of the floor surface by using the camera 142 or the floor sensor 147, and may control the cleaning module changing unit 164 to activate the brush 1641 instead of the wet mop 1643 according to the sensed characteristics of the floor surface. The processor 180 may drive the dust collecting motor 162 to perform the cleaning operation on foreign matter or dust on the floor surface.

That is, according to the embodiment illustrated in FIGS. 8 to 10, the cleaning robot 100*a* may sense the characteristics of the floor surface or the characteristics of the contaminant and perform the cleaning operation according to the cleaning method suitable for the sensed characteristics, thereby improving the cleaning performance.

In addition, since the cleaning robot 100*a* can intelligently perform the cleaning operation on the contaminant having various characteristics, it is possible to minimize the deterioration of cleanliness in the space or the damage or error of the cleaning robot as a result of performing a wrong cleaning operation on a specific contaminant.

Figure 11:
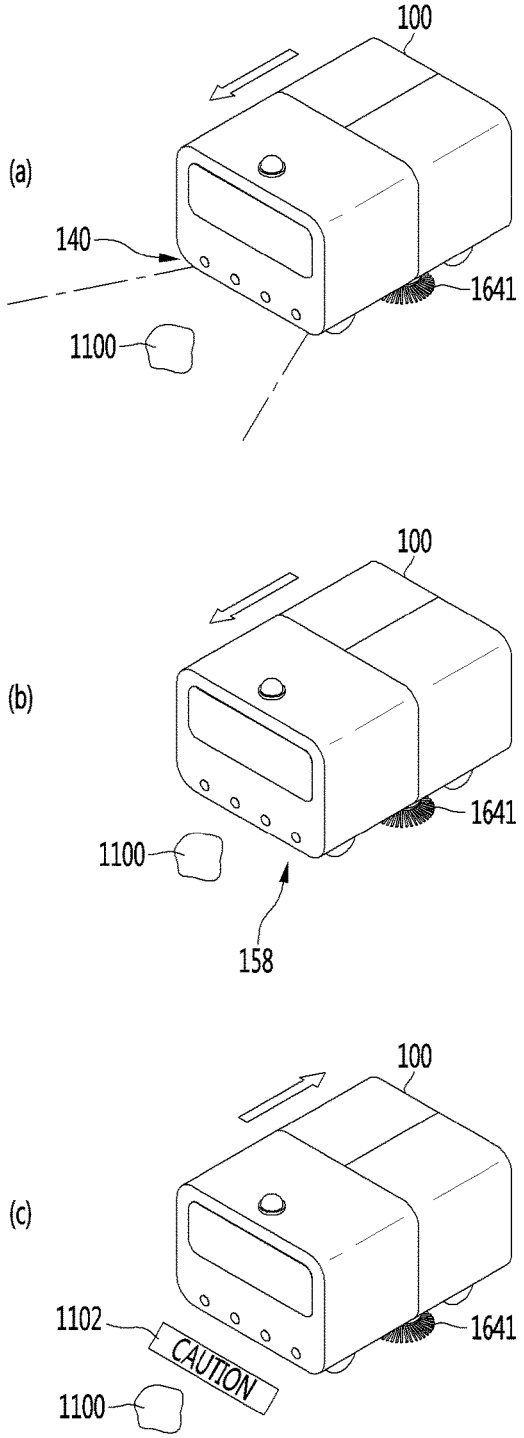
FIG. 11 illustrates an example of the operation of the cleaning robot when a sensed contaminant is a non-cleanable contaminant, in relation to the embodiment of FIG. 8.

FIG. 11 illustrates an example of the operation of the cleaning robot when a detected contaminant is a non-cleanable contaminant, in relation to the embodiment of FIG. 8.

Referring to FIG. 11(*a*), the cleaning robot 100*a* may sense the contaminant 1100 present in the front by using the sensing unit 140 during traveling, as described above with reference to FIG. 9.

The processor 180 may sense the characteristics of the contaminant 1100 based on the image and/or the sensing values acquired through the sensing unit 140.

However, when data related to the contaminant 1100 does not exist in the memory 170, the processor 180 may not be able to sense the characteristics of the contaminant 1100.

Alternatively, when information indicating that the characteristics of the contaminant 1100 are a non-cleanable contaminant is stored in the memory 170, the processor 180 may sense that the contaminant 1100 is a non-cleanable contaminant.

That is, when the characteristics of the contaminant 1100 are not sensed or are sensed as a non-cleanable contaminant, the processor 180 may not perform the cleaning operation on the contaminant 1100. Therefore, it is possible to prevent deterioration of cleanliness in the space and the damage or error of the cleaning robot 100*a* due to the cleaning operation unsuitable for the contaminant 1100.

Meanwhile, referring to FIGS. 11(*b*) and 11(*c*), when the cleaning robot 100*a* does not perform the cleaning operation on the contaminant 1100, the mark output unit 158 may be controlled to output (print or project) the mark 1102 to the region where the contaminant 1100 is located or the adjacent region. For example, the mark output unit 158 may be disposed at the front lower end of the cleaning robot 100*a*. In this case, the processor 180 may control the traveling motor 166 to approach the contaminant 1100 and then control the mark output unit 158 to output the mark 1102.

For example, when the mark output unit 158 is implemented by a print module that prints the mark 1102 on the floor surface, the processor 180 may move the cleaning robot 100*a* to another region after the mark 1102 is printed on the floor surface and perform the cleaning operation again.

In addition, the processor 180 may transmit information (position, characteristic) about the contaminant 1100 to the manager terminal, the server, or another cleaning robot through the communication unit 110. The manager may remove the contaminant 1100 based on the information about the contaminant 1100. According to the embodiment, when there is another cleaning robot capable of removing the contaminant 1100, the another cleaning robot may move to the region where the contaminant 1100 is located, based on the information about the contaminant 1100, and then perform the cleaning operation on the contaminant 1100.

Hereinafter, an operation of a cleaning robot 100*a* according to another embodiment of the present invention will be described with reference to FIGS. 12 to 14.

Figure 12:
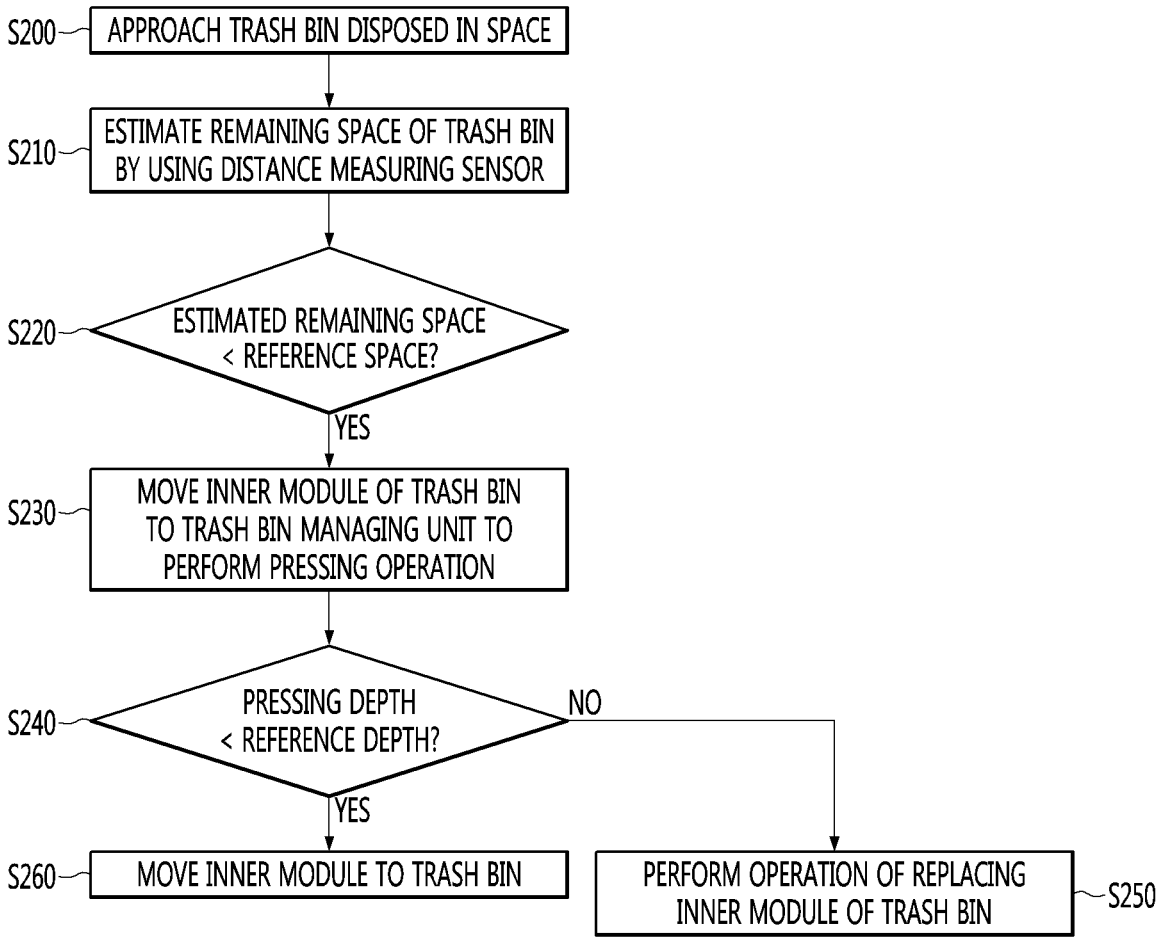
FIG. 12 is a flowchart for describing the control operation of the cleaning robot according to an embodiment of the present invention.

FIG. 12 is a flowchart for describing the control operation of the cleaning robot according to an embodiment of the present invention. FIGS. 13 and 14 are diagrams illustrating an example related to the control operation of the cleaning robot of FIG. 12.

Referring to FIG. 12, the cleaning robot 100*a* may approach a trash bin disposed in a space during traveling (S200).

The cleaning robot 100*a* may perform the cleaning operation according to the embodiment illustrated in FIGS. 8 to 11 while traveling in the space where the cleaning robot 100*a* is disposed.

During execution of the traveling and cleaning operation, the processor 180 may sense the trash bin disposed in the space from the image acquired through the camera 142. Alternatively, the processor 180 may sense, from map data of the space, that the trash exists within a predetermined distance from the current position of the cleaning robot 100*a*.

The processor 180 may control the traveling motor 166 to approach the sensed trash bin according to the sensing result.

The cleaning robot 100*a* may estimate the remaining space of the trash bin by using the distance measuring sensor 148 (S210).

Figure 13:
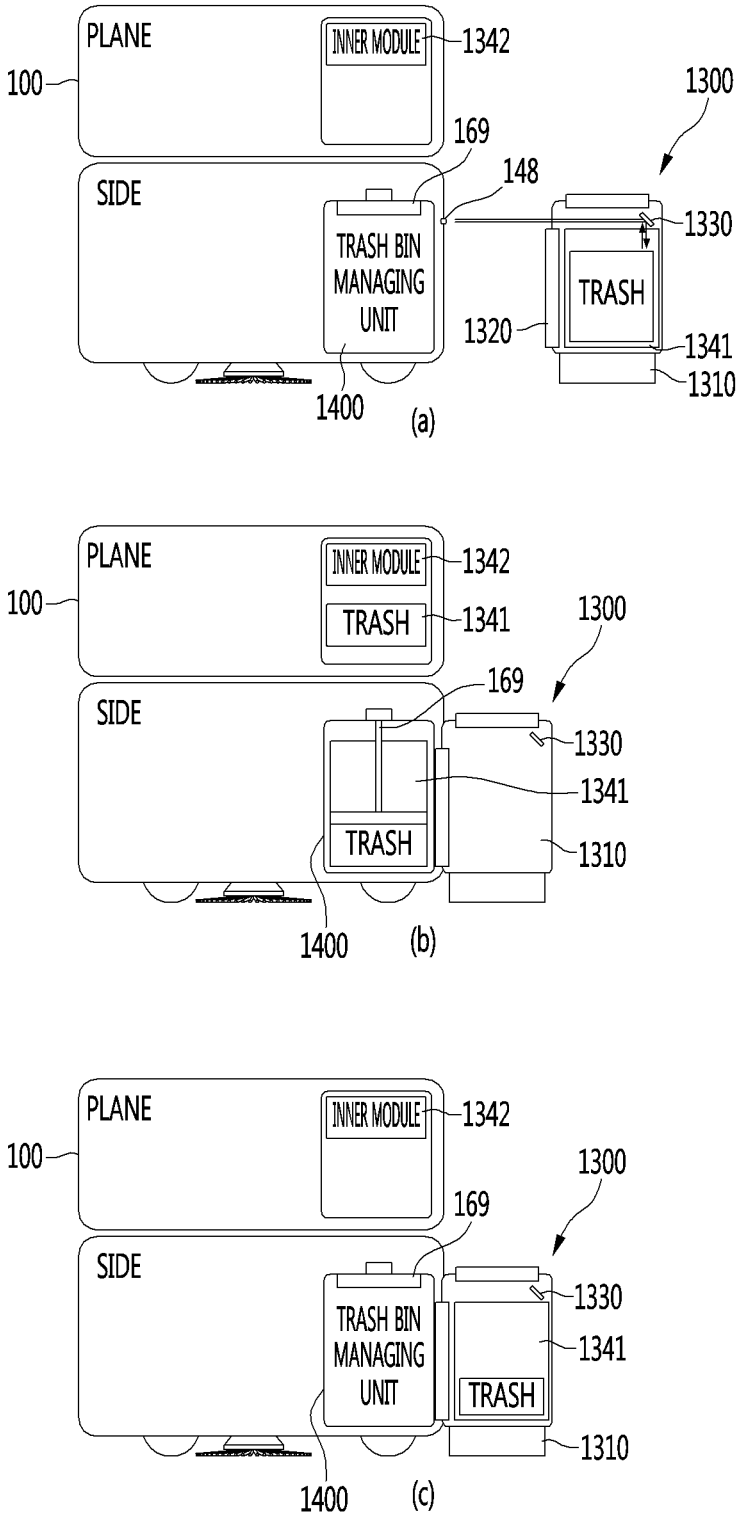
FIGS. 13 and 14 are diagrams illustrating an example related to the control operation of the cleaning robot of FIG. 12.

In this regard, referring to FIGS. 13(*a*) and 14(*b*), the processor 180 may control the traveling motor 166 such that the rear surface of the cleaning robot 100*a* is positioned in front of the trash bin 1300.

Meanwhile, a trash bin managing unit 1400 may be formed inside the cleaning robot 100*a*. The trash bin managing unit 1400 may be implemented separately from the dust collecting unit 103 of FIG. 6. The trash bin managing unit 1400 may form an accommodating space for accommodating at least one inner module 1341 and 1342 that can be accommodated in the trash bin 1300. In addition, the trash bin managing unit 1400 may be provided with a pressing module 169 for pressing the trash accommodated in the inner module.

A distance measuring sensor 148 may be disposed on the rear surface of the cleaning robot 100*a*. The processor 180 may sense the height of the trash accommodated in the inner module 1341 of the trash bin 1300 by using the distance measuring sensor 148.

For example, the trash bin 1300 may include an outer module 1310 forming an appearance, and a door 1320 formed at the front to draw the inner module 1341 accommodating the trash to the outside of the trash bin 1300.

In addition, a reflector 1330 (for example, a mirror) for reflecting a laser beam emitted from the distance measuring sensor 148 downward may be provided inside the trash bin 1300. When the laser light reflected downward is reflected by the trash, the reflector 1330 may reflect the reflected laser light back to the distance measuring sensor 148.

The distance measuring sensor 148 may receive the laser beam reflected by the trash and the reflector 1330.

The processor 180 may sense the height of the trash accommodated in the inner module 1341 of the trash bin 1300 based on the time between the time point when the laser beam is emitted from the distance measuring sensor 148 and the time point when the laser beam is received. The processor 180 may estimate the remaining space of the inner module 1341 of the trash bin 1300 based on the sensed height of the trash.

For example, as the time between the time point when the laser beam is emitted and the time point when the laser beam is received, the height of the trash may be larger and the remaining space of the inner module 1341 is smaller.

FIG. 12 is described again.

When the estimated remaining space is smaller than a reference space (YES in S220), the cleaning robot 100*a* may move the inner module of the trash bin to the trash bin managing unit to perform the operation of pressing the trash accommodated in the inner module (S230).

When the estimated remaining space is smaller than the reference space, it may mean that there is not enough space in the inner module 1341 to further accommodate the trash.

Accordingly, the processor 180 may control the inner module 1341 of the trash bin 1300 to move to the accommodating space in the trash bin managing unit 1400. To this end, the cleaning robot 100*a* may further include a means for opening the door 1320 of the trash bin 1300 and a means for moving the inner module 1341 to the trash bin managing unit 1400. For example, the means may be implemented by a variety of devices, such as a robot arm. The processor 180 may control the means to move the inner module 1341 to the trash bin managing unit 1400.

Referring to FIGS. 13(*b*) and 14(*b*), after the inner module 1341 is moved to the trash bin managing unit 1400, the processor 180 may control the pressing module 169 to perform the operation of pressing the trash accommodated in the inner module 1341. The pressing module 169 may reduce the height of the trash accommodated in the inner module 1341 by pressing the trash downward. Accordingly, the remaining space of the inner module 1341 may be increased.

Meanwhile, when the estimated remaining space is larger than the reference space, the cleaning robot 100*a* does not move the inner module 1341 to the trash bin 1300 and may move to another region after leaving the region where the trash bin 1300 is present.

Meanwhile, the processor 180 may calculate the pressing depth of the trash based on the change in the position of the pressing module 169 according to the pressing operation. As the pressing depth becomes larger, the remaining space of the inner module 1341 may further increase.

When the calculated pressing depth is larger than the reference depth (NO in S240), the cleaning robot 100*a* may move the inner module to the trash bin again (S250).

Referring to FIG. 13(*c*), when the calculated pressing depth is larger than the reference depth, the remaining space of the inner module 1341 may sufficiently increase. Therefore, the processor 180 may move the inner module 1341 to the trash bin 1300 again.

Meanwhile, when the calculated pressing depth is less than the reference depth (YES in S240), the cleaning robot 100*a* may replace the inner module of the trash bin (S260).

Figure 14:
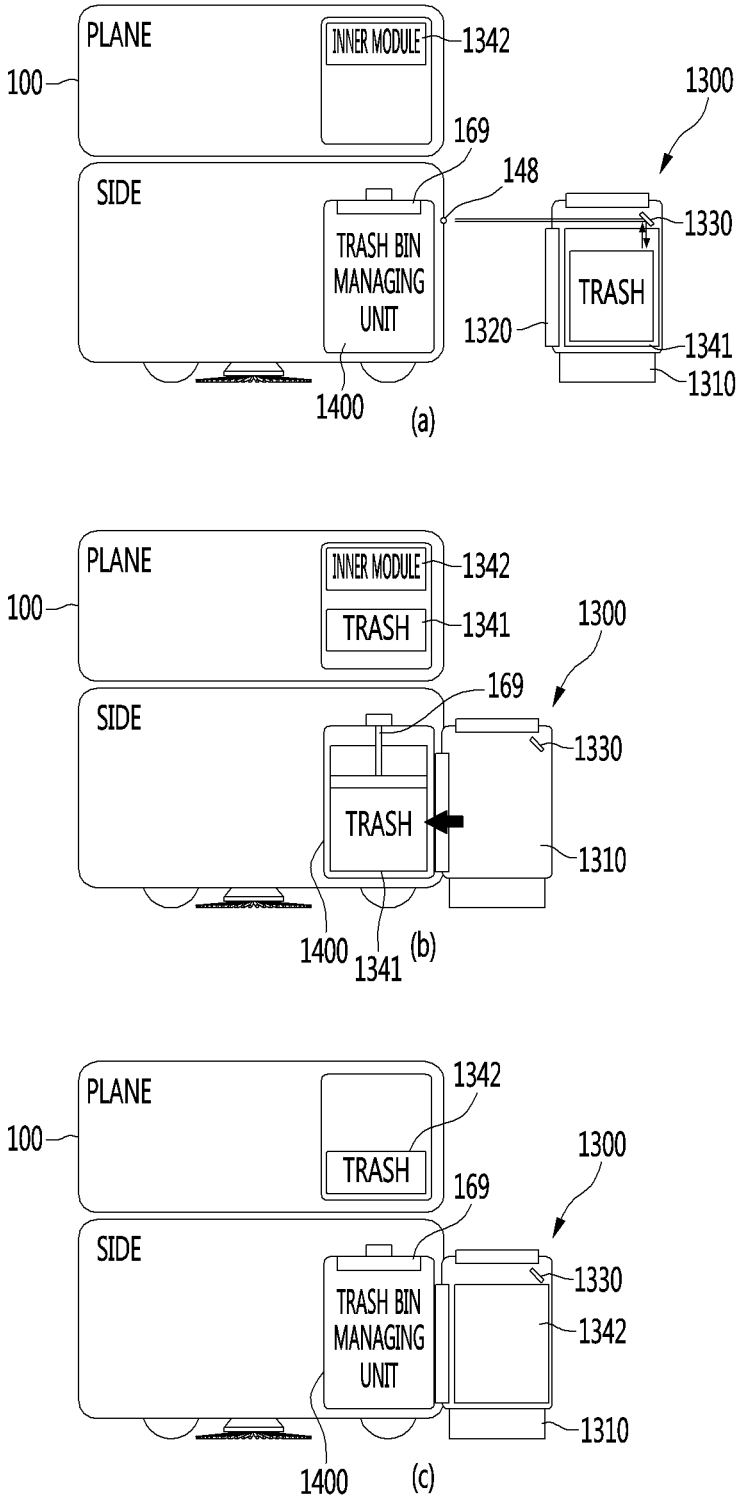

Referring to FIG. 14(*c*), if the calculated pressing depth is less than the reference depth, the remaining space of the inner module 1341 may not be sufficient. Therefore, the processor 180 may perform the operation of replacing the inner module by moving the empty inner module 1342 accommodated in the trash bin managing unit 1400 to the trash bin 1300. As the empty inner module 1342 is accommodated in the trash bin 1300, the trash accommodating space of the trash bin 1300 may increase. According to the embodiment, when there is no spare inner module 1342 in the cleaning robot 100*a*, the processor 180 may transmit the inner module replacement request through the communication unit 110 to the manager terminal, the server, and/or another cleaning robot.

Although not illustrated, the cleaning robot 100*a* may move to a predetermined position after the operation of replacing the inner module is completed, and may take out the inner module 1341 to the outside of the trash bin managing unit 1400.

That is, according to the embodiment illustrated in FIGS. 12 to 14, the cleaning robot 100*a* may automatically manage the trash bin disposed in the space. In particular, the cleaning robot 100*a* includes the pressing module for pressing the trash in the inner module of the trash bin, thereby enabling efficient use of the trash bin.

The above description is merely illustrative of the technical idea of the present invention, and various modifications and changes may be made thereto by those skilled in the art without departing from the essential characteristics of the present invention.

Therefore, the embodiments of the present invention are not intended to limit the technical spirit of the present invention but to illustrate the technical idea of the present invention, and the technical spirit of the present invention is not limited by these embodiments.

The scope of protection of the present invention should be interpreted by the appending claims, and all technical ideas within the scope of equivalents should be construed as falling within the scope of the present invention.

The invention claimed is:

1. A cleaning robot comprising:

a traveling motor configured to generate a driving force for traveling;

a cleaning module changing unit configured to selectively activate any one of at least one cleaning module;

a sensing unit configured to sense characteristics of a floor surface;

a trash bin management unit configured to form an accommodating space capable of accommodating an inner module of a trash bin, and the trash bin management unit includes a pressing module; and a processor configured to perform a cleaning operation of cleaning the floor surface by controlling the cleaning module changing unit to activate any one of the at least one cleaning module based on the sensed characteristics of the floor surface, wherein the processor is configured to:

sense characteristics of a contaminant present on the floor surface by using the sensing unit while performing the cleaning operation; and control the cleaning module changing unit to change or maintain the activated cleaning module based on the sensed characteristics of the contaminant, wherein the processor is configured to:

when the trash bin is sensed during traveling, control the traveling motor so as to approach the sensed trash bin;

sense a height of a trash accommodated in the inner module of the trash bin by using a distance measuring sensor, move the inner module from the trash bin to the trash bin management unit based on the sensed height; and control the pressing module to press the trash accommodated in the inner module.

2. The cleaning robot according to claim 1, wherein the sensing unit comprises at least one of a camera or a floor sensor, and the processor is configured to sense the characteristics of the floor surface based on at least one of an image acquired from the camera or a sensing value of the floor sensor.

3. The cleaning robot according to claim 2, further comprising a memory configured to store a learning model learned by a learning processor, wherein the processor is configured to recognize the characteristics of the floor surface from at least one of the acquired image or the sensing value through the learning model stored in the memory.

4. The cleaning robot according to claim 2, further comprising a communication unit configured to connect to a server, wherein the processor is configured to:

control the communication unit to transmit at least one of the acquired image or the sensing value to the server; and receive, from the server, data including the characteristics of the floor surface based on at least one of the acquired image or the sensing value.

5. The cleaning robot according to claim 1, wherein the sensing unit comprises at least one of a camera, an odor sensor, or a liquid sensor, and the processor is configured to sense presence or absence of the contaminant or the characteristics of the contaminant based on at least one of an image acquired through the camera, a first sensing value acquired by the odor sensor, or a second sensing value acquired by the liquid sensor.

6. The cleaning robot according to claim 5, further comprising a memory configured to store a learning model learned by a learning processor, wherein the processor is configured to recognize the presence or the absence of the contaminant or the characteristics of the contaminant from at least one of the image, the first sensing value, or the second sensing value through the learning model stored in the memory.

7. The cleaning robot according to claim 1, wherein the cleaning module changing unit comprises:

a cleaning module switching motor; and a switching bar formed to extend along a rotational shaft of the cleaning module switching motor and fixed to each of the at least one cleaning module, wherein any one of the at least one cleaning module is brought into contact with the floor surface based on a rotational angle of the switching bar and the cleaning module switching motor.

8. The cleaning robot according to claim 7, wherein the processor is configured to:

select any one of the at least one cleaning module based on the sensed characteristics of the floor surface or the characteristics of the contaminant; and control the cleaning module switching motor such that the selected cleaning module is brought into contact with the floor surface.

9. The cleaning robot according to claim 1, wherein the processor is configured to change or maintain the activated cleaning module based on the sensed characteristics of the contaminant and perform the cleaning operation on the contaminant by controlling the traveling motor such that the cleaning module travels to a region where the contaminant is located.

10. The cleaning robot according to claim 9, wherein the processor is configured to:

sense whether the contaminant remains by using the sensing unit after performing the cleaning operation on the contaminant; and when it is sensed that the contaminant remains, perform the cleaning operation on the remaining contaminant by controlling the traveling motor such that the cleaning module travels to a region where the contaminant remains.

11. The cleaning robot according to claim 9, further comprising a dust collecting motor and a dust container configured to accommodate foreign matter or dust suctioned according to driving of the dust collecting motor, wherein the processor is configured to drive or stop the dust collecting motor during traveling to the region where the contaminant is located, based on the sensed characteristics of the contaminant.

12. The cleaning robot according to claim 1, further comprising at least one ultraviolet light source configured to emit ultraviolet light to the floor surface.

13. The cleaning robot according to claim 1, wherein, when it is sensed that the sensed contaminant is a non-cleanable contaminant, the processor is configured to control the traveling motor so as not to pass through the region where the contaminant is located.

14. The cleaning robot according to claim 13, further comprising a mark output unit configured to output a mark indicating the presence of the contaminant to the floor surface, wherein the processor is configured to control the mark output unit to output the mark to a region where the non-cleanable contaminant is located or a adjacent region.

15. The cleaning robot according to claim 13, wherein the processor is configured to transmit information about the non-cleanable contaminant to at least one of a manager terminal, a server, or another cleaning robot through a communication unit.

16. The cleaning robot according to claim 1, wherein the processor is configured to:

calculate a pressing depth of the trash based on a position change of the pressing module; and move the inner module to the trash bin when the calculated pressing depth is greater than a reference depth.

17. The cleaning robot according to claim 1, wherein the processor is configured to:

calculate a pressing depth of the trash based on a position change of the pressing module; and move another inner module accommodated in the trash bin management unit to the trash bin when the calculated pressing depth is less than a reference depth.

18. The cleaning robot according to claim 17, wherein, when the another inner module is not accommodated in the trash bin management unit, the processor is configured to transmit a request for replacement of the inner module of the trash bin to at least one of a manager terminal, a server, or another cleaning robot through a communication unit.

* * * * *